US007892006B2

(12) United States Patent
Guan et al.

(10) Patent No.: US 7,892,006 B2
(45) Date of Patent: Feb. 22, 2011

(54) CONNECTOR HAVING AN IMPROVED FASTENER

(75) Inventors: Hai-Fei Guan, Kunshan (CN); Xue-Wu Bu, Kunshan (CN); Ting-Shun Liu, Kunshan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 12/619,696

(22) Filed: Nov. 17, 2009

(65) Prior Publication Data

US 2010/0167558 A1 Jul. 1, 2010

(30) Foreign Application Priority Data

Dec. 29, 2008 (CN) ..... 2008 2 0303804

(51) Int. Cl.
*H01R 13/62* (2006.01)

(52) U.S. Cl. ..... 439/328; 439/567

(58) Field of Classification Search ..... 439/328, 439/567, 570

See application file for complete search history.

(56) References Cited

U.S. PATENT DOCUMENTS

| | | | | |
|---|---|---|---|---|
| 5,154,634 | A | 10/1992 | Brown et al. | |
| 6,824,407 | B1 * | 11/2004 | Zhao et al. | 439/157 |
| 7,641,495 | B1 * | 1/2010 | Sun | 439/327 |
| 2002/0081900 | A1 * | 6/2002 | Yu et al. | 439/567 |
| 2005/0106937 | A1 * | 5/2005 | Lin | 439/567 |

* cited by examiner

*Primary Examiner*—Hien Vu
(74) *Attorney, Agent, or Firm*—Wei Te Chung; Andrew C. Cheng; Ming Chieh Chang

(57) ABSTRACT

A connector includes an insulative housing having a pair of side walls with a central slot formed therebetween, a set of terminals including first terminals and second terminals and an ejector. Each side wall has a set of passageways. Each first terminal has a first contacting portion protruding into the central slot, a first tail portion mounted on a PCB, and a first connecting portion. The first connecting portions and the first tail portions are arranged in two rows.

13 Claims, 6 Drawing Sheets

CONNECTOR HAVING AN IMPROVED FASTENER

BACKGROUND OF THE INVENTION

1. Field of the invention

The present invention generally relates to a connector for being mounted on a PCB and more particularly to a connector having fasteners for securing the connector to the PCB.

2. Description of Related Art

Prior art connectors which are used to connect a memory module with a Printed Circuit Board (PCB) usually include an elongated insulative housing having a central slot for accommodating the memory module, a plurality of terminals coupled to the insulative housing and protruding into the central slot for mating with the memory module, and a plurality of fasteners for securing the connector to the PCB. The fastener has a base portion retained in the insulative housing, and a board lock extending from the base portion for being mounted to the PCB by a through hole technology (THT) so as to secure the connector to the PCB.

However, the board lock is generally planar, when the connector is subject to shock or vibration, the board lock will have a deformation or breakage easily.

Hence, an improvement over the prior art is required to overcome the problems thereof.

SUMMARY OF THE INVENTION

According to one aspect of the present invention, a connector for being mounted on a PCB comprises a longitudinal insulative housing having a pair of side walls with a central slot formed therebetween for accommodating a memory module. Each side wall defines a plurality of passageways communicating with the central slot. A plurality of terminals define retaining portions retained in the passageways, contacting portions protruding into the central slot for mating with the memory module, and tail portions for being mounted on the PCB. A plurality of fasteners are coupled to the insulative housing. Each fastener has a board lock for being mounted through a hole in the PCB and a pair of soldering pads for being mounted onto a surface of the PCB.

According to another aspect of the present invention, A fastener for securing a connector to a PCB comprises a base portion for being retained in the connector, a board lock extending from the base portion for being mounted to the PCB by through hole technology, and a pair of soldering pads extending from the base portion for being mounted to the PCB by surface mount technology.

These and additional objects, features, and advantages of the present invention will become apparent after reading the following detailed description of the preferred embodiment of the invention taken in conjunction with the appended drawings.

DETAILED DESCRIPTION OF THE INVENTION

Figure 1:
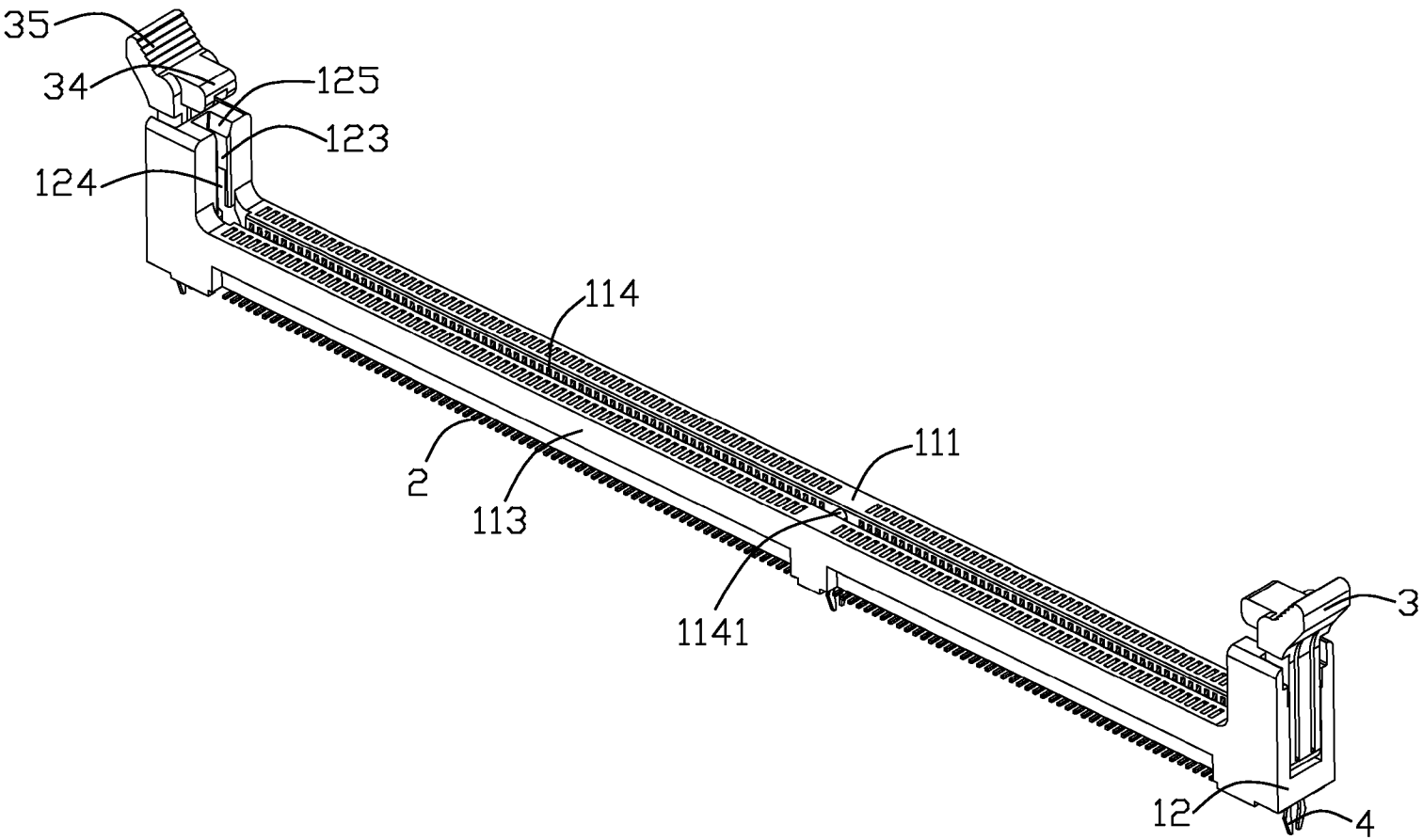
FIG. 1 is a perspective view of a connector according to the present invention.
Figure 2:
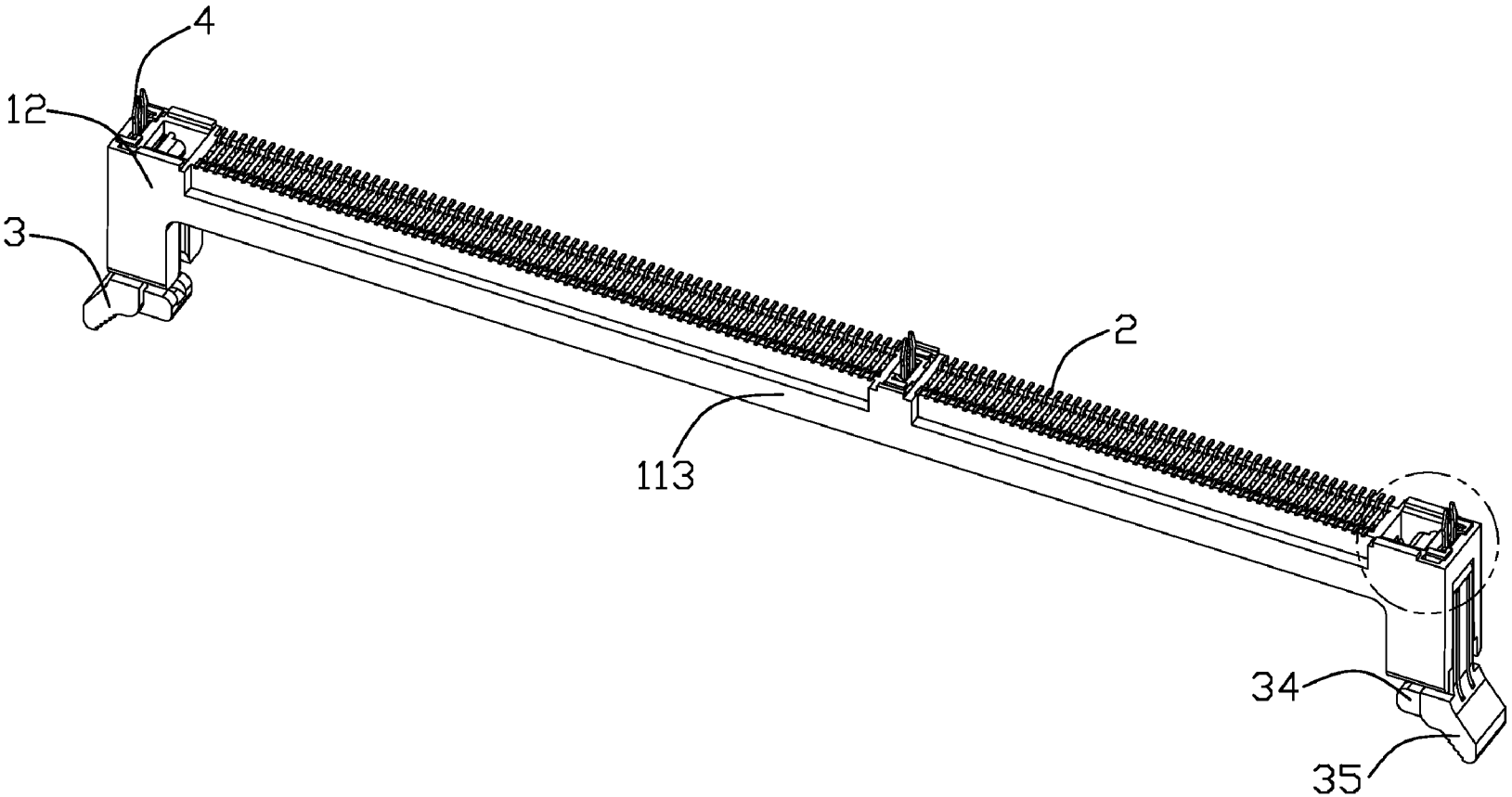
FIG. 2 is an another perspective view of the connector shown in FIG. 1.
Figure 3:
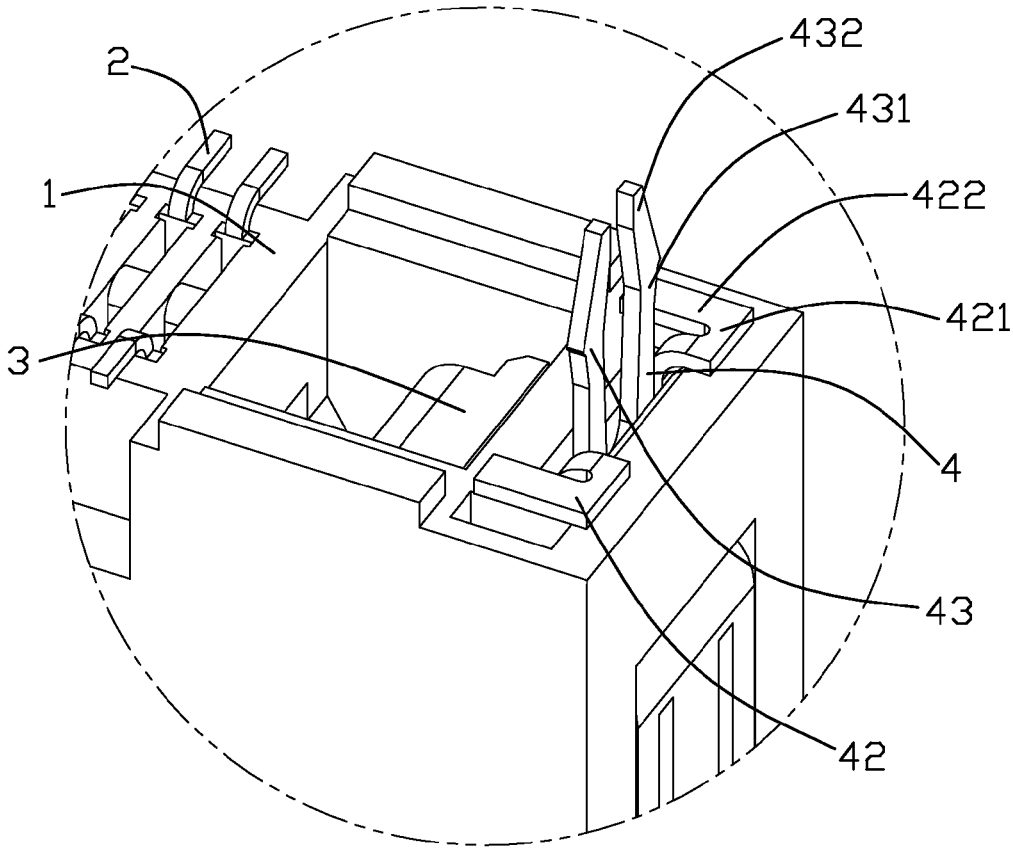
FIG. 3 is a partly enlarged view of a circle portion shown in FIG. 2.

Reference will now be made to the drawing figures to describe the preferred embodiment of the present invention in detail.

Figure 4:
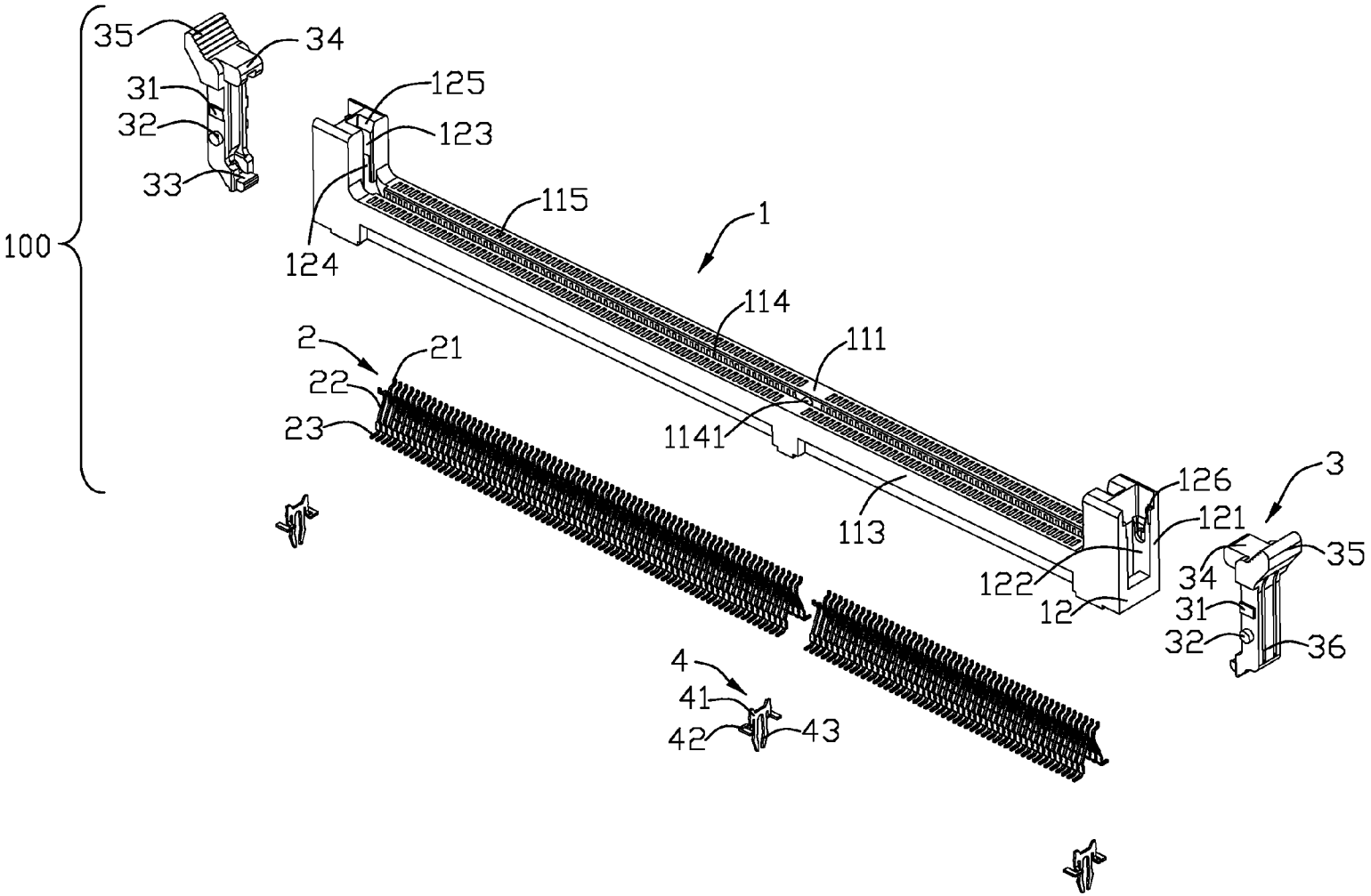
FIG. 4 is an exploded view of the connector shown in FIG. 1.

Referring to FIGS. 1, and 4, a connector 100 for being mounted to a Printed Circuit Board (PCB hereinafter, not shown) according to the present invention, includes an longitudinal insulative housing 1, a plurality of terminals 2 retained in the insulative housing 1, a pair of ejectors 3 coupled to the insulative housing 1 and a pair of fasteners 4 for securing the insulative housing 1 to the PCB.

Referring to FIGS. 1-4, the insulative housing 1 which is longitudinal has an upper surface 111, a lower surface 112 opposite to the upper surface 111, a pair of side walls 113 extending along the longitudinal direction and a central slot 114 formed between the side walls 113. A protrusion 1141 is formed in a proper position of the central slot 114 for preventing a memory module from mismating. The insulative housing 1 has a number of passageways 115 passing through the upper surface 111 and the lower surface 112 and communicating with the central slot 114. The insulative housing 1 has a pair of tower portions 12 extending upwardly from two longitudinal ends thereof Each tower potion 12 has a pair of lateral walls 121, a receiving slot 122 formed between the lateral walls 121 for receiving the ejector 3, a pair of guiding walls 123 extending towards each other, and a guiding slot 124 formed between the guiding walls 123 and communicating with the central slot 114. each guiding wall 123 defines a guiding face 125 for guiding the memory module into the guiding slot 124. Each lateral wall 121 has a aperture 126 formed thereon and communicating with the receiving slot 122. The insulative housing 1 has a pair of first retaining slots 127 recessed upwardly from lower surfaces of the respective tower portions 12 and a second retaining slot 128 recessed upwardly from the lower surface 112 at a position with respect to the protrusion 1141.

Each terminal 2 has a contacting portion 21 protruding into the central slot 114 for mating with the memory module, a retaining portion 22 retained in the passageway 115 and a tail portion 23 extending out of the lower surface 112 for being mounted on the PCB.

The ejectors 3 are received in the receiving slots 122 of the tower portions 12. Each ejector 3 has a main body 36, a pair of projections 31 and a pair of spindles 32 formed on two lateral sides of the main body 36, an ejecting portion 33 extending inwardly into the central slot 114 from a lower end of the main body 36 for ejecting the memory module out of the central slot 114, a latching portion 34 extending inwardly from an upper end of the main body 36 for latching the memory module into the central slot 114 and an gripping portion 35 extending outwardly from the upper end of the main body 36 for facilitating urging the ejector 3. The spindles 32 are received in the respective apertures 126 thereby allowing the ejector 3 to rotate relative to the insulative housing 1.

Figure 5:
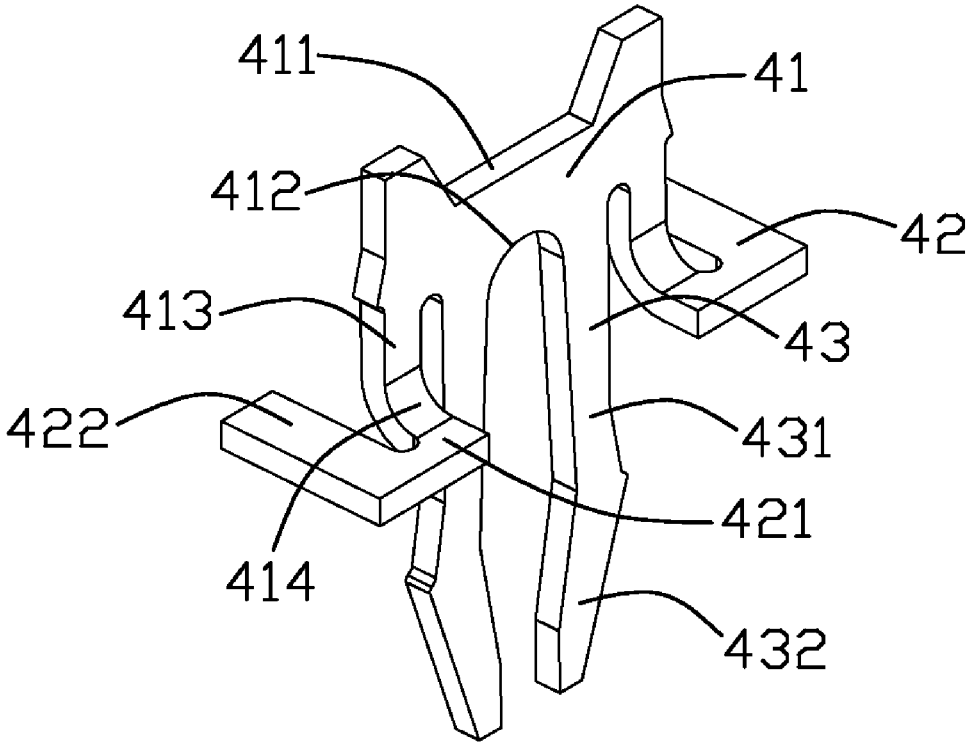
FIG. 5 is a perspective view of a fastener of the connector shown in FIG. 1.
Figure 6:
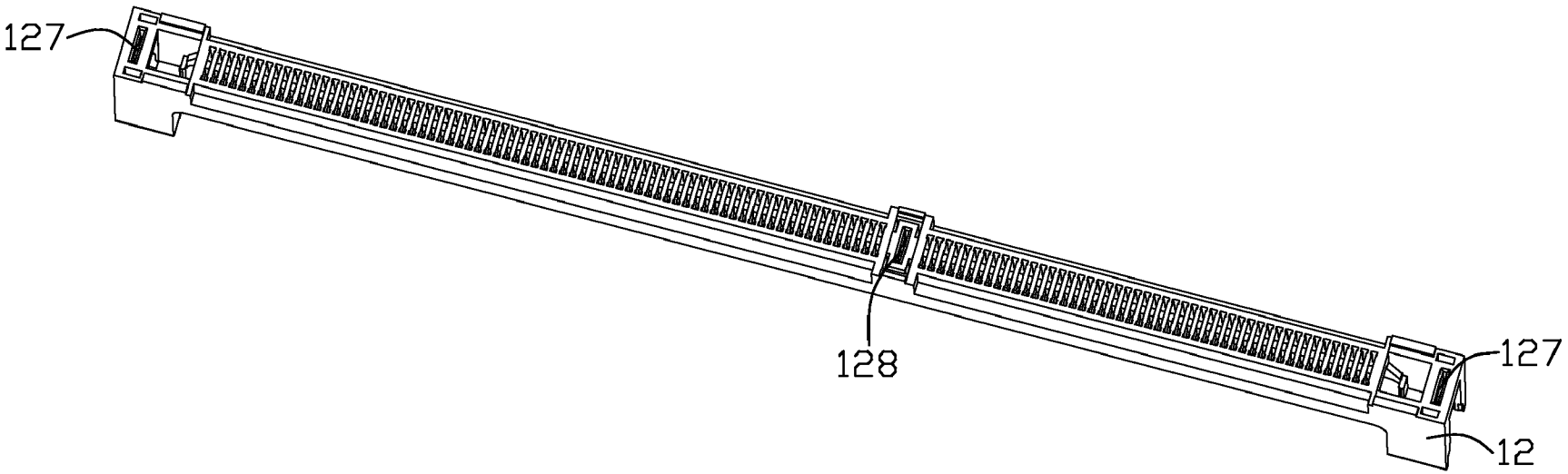
FIG. 6 is a perspective view of an insulative housing of the connector shown in FIG. 1.

Referring to FIG. 5, the fasteners 4 are retained in the first retaining slots 127 and the second retaining slot 128. each fastener 4 has a base portion 41 defining an upper edge 411 and a lower edge 412, a board lock 43 extending downwardly from the lower edge 412 for being mounted through a hole provided in the PCB, a pair of soldering pads 42 extending from the lower edge 412 and locating at two lateral sides of the board lock 43 symmetrically for being mounted directly onto a surface of the PCB. In the other words, the board lock 43 is mounted to the PCB by through hole technology (THT), the soldering pads 42 are mounted to the PCB by surface mount technology (SMT). The base portion 41 is received in the first or second retaining slot 127, 128 and has a pair of agnails (not labeled) on two lateral sides thereof for interfering with the insulative housing 1. The board lock 43 includes a pair of legs. Each leg has a connecting portion 431 extending downwardly from the lower edge 412, and a buckling arm 432 extending downwardly from a lower end of the connecting portion 431 for being locked in the hole of the PCB. Each soldering pad 2 has an arm portion 413 extending downwardly from the lower edge 412, a bending portion 414 bending from a lower end of the arm portion 413, and a L-shaped portion including a first portion 421 extending outwardly from the bending portion 414 to a lateral side of the fastener 4 and a second portion 422 extending from the first portion 421 and perpendicular to the first portion 421. the board lock 43 extends downwardly beyond the L-shaped portion and is generally perpendicular to L-shaped portion. The arm portions 413 are spaced from the legs of the board lock 43 along a lateral direction of the fastener to increase the distance between the L-shaped portions and the board lock 43. The L-shaped portions are sandwiched between the PCB and the lower surface 112 of the insulative housing 1 to secure the soldering portion 42 on the PCB stably. When the fasteners 4 are mounted to the PCB, the fasteners 4 could be retained on the PCB firmly by both the board lock 43 mounted to the PCB through THT and the soldering pads 42 mounted to the PCB through SMT, the soldering pads 42 of each fastener 4 locating at the two lateral sides of the board lock 43 and having L-shaped portions being seated against the PCB could present the board lock 43 from vibration.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A connector for being mounted on a PCB, comprising:

a longitudinal insulative housing having a pair of side walls with a central slot formed therebetween for accommodating a memory module, each side wall defining a plurality of passageways communicating with the central slot;

a plurality of terminals defining retaining portions retained in the passageways, contacting portions protruding into the central slot for mating with the memory module, and tail portions for being mounted on the PCB; and a plurality of fasteners coupled to the insulative housing, each fastener having a board lock for being mounted through a hole in the PCB and a pair of soldering pads for being mounted onto a surface of the PCB;

wherein the insulative housing has a plurality of retaining slots, each fastener has a base portion received in the respective retaining slot, the board lock extends downwardly from a lower edge of the base portion, the soldering pads extend from the lower edge of the base portion and locate at two lateral sides of the board lock symmetrically;

wherein the soldering pad comprises an arm portion extending downwardly from the lower edge, a bending portion bending from a lower end of the arm portion, and a L-shaped portion extending horizontally from the bending portion and being seated against the PCB, the L-shaped portion comprises a first portion extending outwardly from the bending portion to a lateral side of the fastener and a second portion extending from the first portion and perpendicular to the first portion.

2. The connector as claimed in claim 1, wherein the arm portion is spaced from the board lock along a lateral direction of the fastener.

3. The connector as claimed in claim 1, wherein the board lock extending downwardly beyond the L-shaped portion.

4. The connector as claimed in claim 1, wherein the L-shaped portions are sandwiched between a lower surface of the insulative housing and the PCB.

5. The connector as claimed in claim 1, wherein the insulative housing has a pair of tower portions formed at two longitudinal ends thereof, the connector further comprises a pair of ejectors rotatably retained in the tower portions for latching or ejecting the memory module, the retaining slots comprise a pair of first retaining slots recessed from lower surfaces of the respective tower portions for receiving the base portions.

6. A fastener for securing a connector to a PCB, comprising:

a base portion for being retained in the connector;

a board lock extending from the base portion for being mounted to the PCB by through hole technology; and a pair of soldering pads extending from the base portion for being mounted to the PCB by surface mount technology;

wherein the board lock extends downwardly from a lower edge of the base portion, the soldering pads extend from the lower edge of the base portion and are located at two lateral sides of the board lock symmetrically;

wherein the soldering pad comprises an arm portion extending downwardly from the lower edge, a bending portion bending from a lower end of the arm portion, and a L-shaped portion extending horizontally from the bending portion and being seated against the PCB, the L-shaped portion comprises a first portion extending outwardly from the bending portion to a lateral side of the fastener and a second portion extending from the first portion and perpendicular to the first portion; and wherein the L-shaped portions are sandwiched between a lower surface of the connector and the PCB.

7. The connector as claimed in claim 6, wherein the arm portion is spaced from the board lock along a lateral direction of the fastener.

8. The connector as claimed in claim 6, wherein the board lock extending downwardly beyond the L-shaped portion.

9. An electrical connector for mounting to a printed circuit board, comprising:

an insulative housing defining a mounting face and a mating face;

a plurality of contacts disposed in the housing with contacting sections approachable through the mating face from an exterior and with mounting sections for mounting to the said printed circuit board;

at least one metal fastener for retaining the housing upon the printed circuit board, said fastener including:

a upper base portion having retention devices thereon and received in a corresponding slot which extends upward from the mounting face;

a horizontal middle portion extending horizontally from the upper base portion at a first level; and a board lock extending downwardly from the upper base portion at a second level, which is higher than the first level, for locking to a through hole in said printed circuit board;

wherein both said upper base portion and said board lock extend in a vertical direction;

wherein said horizontal middle portion includes opposite inner and outer parts respectively located by two sides of a plane defined by the base portion under condition that the inner part is located closer to a centerline of the housing than said outer part in a transverse direction; and wherein the insulative housing has a plurality of retaining slots, each fastener has a base portion received in the respective retaining slot, the board lock extends downwardly from a lower edge of the base portion, soldering pads extend from the lower edge of the base portion and locate at two lateral sides of the board lock symmetrically, each of the soldering pads comprises an arm portion extending downwardly from the lower edge, a bending portion bending from a lower end of the arm portion, and a L-shaped portion extending horizontally from the bending portion and being seated against the PCB, the L-shaped portion comprises a first portion extending outwardly from the bending portion to a lateral side of the fastener and a second portion extending from the first portion and perpendicular to the first portion.

10. The electrical connector as claimed in claim 9, wherein the inner part is unitarily extends from the base portion in a first direction while the outer part unitarily extends from the inner part in a second direction opposite to the first direction under condition that both said first direction and said second direction are perpendicular to said transverse direction.

11. The electrical connector as claimed in claim 10, wherein the board lock is located closer to the centerline of the housing than the inner part in said transverse direction.

12. The electrical connector as claimed in claim 11, wherein there are two sets of said horizontal middle portion and said board lock both of which unitarily extend from the same upper base portion and arranged symmetrically arranged by two sides of said centerline.

13. The electrical connector as claimed in claim 12, wherein said first direction is essentially a longitudinal direction defined by the housing.

* * * * *